US006550256B1

(12) United States Patent
Myneni

(10) Patent No.: US 6,550,256 B1
(45) Date of Patent: Apr. 22, 2003

(54) ALTERNATIVE BACKING UP PUMP FOR TURBOMOLECULAR PUMPS

(75) Inventor: Ganapati Rao Myneni, Yorktown, VA (US)

(73) Assignee: Southeastern Universities Research Assn., Newport News, VA (US)

( * ) Notice: Subject to any disclaimer, the term of this patent is extended or adjusted under 35 U.S.C. 154(b) by 0 days.

(21) Appl. No.: 09/941,344

(22) Filed: Aug. 29, 2001

(51) Int. Cl.[7] ..... B01D 8/00; F04B 15/08
(52) U.S. Cl. ..... 62/55.5; 417/901
(58) Field of Search ..... 62/55.5; 417/901

(56) References Cited

U.S. PATENT DOCUMENTS 3,719,052 A * 3/1973 White ..... 62/3.2
4,446,702 A * 5/1984 Peterson et al. ..... 417/901
4,514,204 A * 4/1985 Bonney et al. ..... 62/268
4,724,677 A * 2/1988 Foster ..... 165/94
5,365,742 A * 11/1994 Boffito et al. ..... 252/181.5
5,408,832 A * 4/1995 Boffito et al. ..... 428/69
5,513,499 A * 5/1996 deRijke ..... 415/90
5,687,574 A * 11/1997 Longsworth et al. ..... 417/901
RE36,610 E * 3/2000 Okumura et al. ..... 415/90
6,054,862 A * 4/2000 Zhou ..... 324/460
6,220,824 B1 * 4/2001 Hablanian ..... 417/201
6,257,001 B1 * 7/2001 Muldowney et al. ..... 62/125

* cited by examiner

*Primary Examiner*—William C. Doerrler

(57) ABSTRACT

As an alternative to the use of a mechanical backing pump in the application of wide range turbomolecular pumps in ultra-high and extra high vacuum applications, palladium oxide is used to convert hydrogen present in the evacuation stream and related volumes to water with the water then being cryo-pumped to a low pressure of below about $1.e^{-3}$ Torr at 150° K. Cryo-pumping is achieved using a low cost Kleemenco cycle cryocooler, a somewhat more expensive thermoelectric cooler, a Venturi cooler or a similar device to achieve the required minimization of hydrogen partial pressure.

1 Claim, 2 Drawing Sheets

ALTERNATIVE BACKING UP PUMP FOR TURBOMOLECULAR PUMPS

The United States of America may have certain rights to this invention under Management and Operating Contract No. DE-AC05-84ER 40150 from the Department of Energy.

FIELD OF THE INVENTION

The present invention relates to pumping systems for ultra-high and extreme high vacuum applications, and more particularly to backing up pumps for turbomolecular pumps in such applications.

BACKGROUND OF THE INVENTION

Recent technological advances in wide range turbopumps make them very attractive for ultra-high and extreme high vacuum applications. The major deterrent to the use of such pumps is the need for a backing up pump (such as a diaphragm pump) as a roughing pump. Extended operation of a wide range turbopump without a backing pump has been demonstrated by Weber et al., JVST A 14(5) 2695–2698. According to this work, such operation was accomplished in a 13 liter volume that was initially evacuated with a sorption pump and then valved off. In such an arrangement, the principal difficulty is achieving a low partial pressure of hydrogen due to the tendency of hydrogen to adsorb to the walls of most volume containers. The use of a sputter-ion pump has also been suggested and demonstrated as an alternative backing pump in such applications.

OBJECT OF THE INVENTION

It is therefore an object of the present invention to provide an alternative to a backing pump in the application of turbomolecular pumps in ultra-high and extra high vacuum applications.

SUMMARY OF THE INVENTION

According to the present invention, palladium oxide is used to convert hydrogen present in the evacuation stream and related volumes to water with the water then being cryo-pumped to a low pressure of below about $1.e^{-5}$ Torr at 150° K. Cryo-pumping is achieved using a low cost Kleemenco cycle cryocooler or a somewhat more expensive thermoelectric cooler such as a Peltier cooler. Such a system serves as a relatively low cost, yet highly efficient substitute for the previously described prior art apparatus.

DETAILED DESCRIPTION

The pump system of the present invention addresses the problem of reducing the partial pressure of hydrogen in ultra-high and extreme high vacuum situations through the use of a combination of a relatively inexpensive cryocooler and a coating of palladium oxide on the interior of the cooler to convert hydrogen to water that is then cryopumped to a pressure of $1.e^{-5}$ Torr at 150° K. for evacuation from the cooler.

Figure 1:
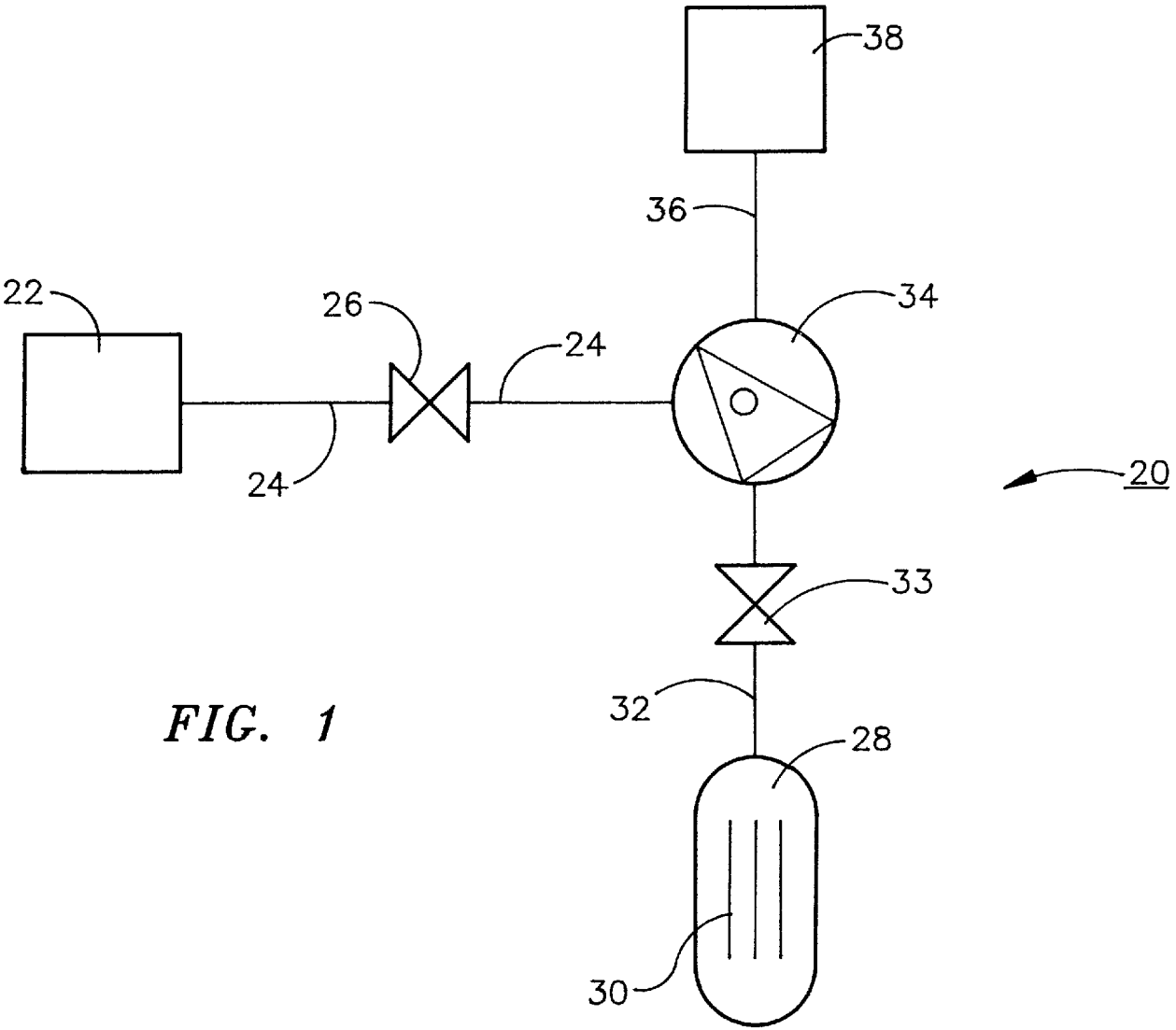
FIG. 1 is a schematic drawing of the pump system of the present invention.

Referring now to FIG. 1 that shows a schematic diagram of the pump system 20 of the present invention, comprising a roughing pump 22, conduit 24 including valve 26, cooler 28 containing cooler plates 30, conduit 32 including valve 33 and turbomolecular pump 34 all connected via conduit 36 to a vacuum chamber 38. Roughing pump 22, conduits 24, 32 and 36, valves 26 and 33 and turbomolecular pump 34 are all of conventional design and construction in accordance with well defined and well known methods and techniques familiar to those skilled in the ultra-high (UHV) and extreme high (XHV) vacuum arts. It is in the incorporation of cooler 28 in the vacuum circuit (comprising collectively, valves 26 and 33, conduits 24, 32 and 36 and the various other elements of the pump system 20), and also in the coating of the interior, or at least portions thereof with palladium oxide as a substitute for a conventional backing up pump, that the pump system 20 of the present invention differs significantly from those of the prior art.

According to the present invention, UHV and XHV conditions are achieved by careful cleaning of the UHV or XHV chamber 38 with ultra pure water, baking out at a temperature of above about 425° K. and then applying the novel backing up pump system 20 described herein to achieve UHV and XHV conditions with the virtual total absence of any carbon oxides that might adversely affect any experiments or activities being conducted under such extreme vacuum conditions in vacuum chamber 38.

Cryocooler 28 may be any of a variety of cryocooling devices as described below so long at it is capable of obtaining a temperature of about 150° K. at pressures below about $1.e^{-3}$ Torr or lower. So-called Kleemenco cycle coolers pass compressed gases down a counter current heat exchanger allowing the gas to expand through a capillary or throttling valve. Cooling occurs upon expansion of the gas and the cooled gas passes back up the heat exchanger, pre-cooling the incoming high-pressure gas. These low-cost single stream, throttle expansion cycle refrigeration devices use a mixture of refrigerants and operate effectively between about 65° K. and 150° K. Such coolers are extremely reliable and comparable in efficiency to Stirling and Gifford-McMahon cryocoolers, but significantly less expensive.

Recent developments utilizing vapor-liquid separators to inhibit compressor oil agglomeration at lower temperatures has further improved the efficiency and low temperature operating capabilities of these devices. Further advances using high efficiency oil separators, oil purification and meticulous system cleanliness with the proper selection of refrigerant have even further improved the efficiency of these systems without significantly affecting their cost. Useful such cryocoolers are commercially available from APD Cryogenics, Inc., 1833 Vultee St., Allentown, Pa. 18103-4783.

Figure 2:
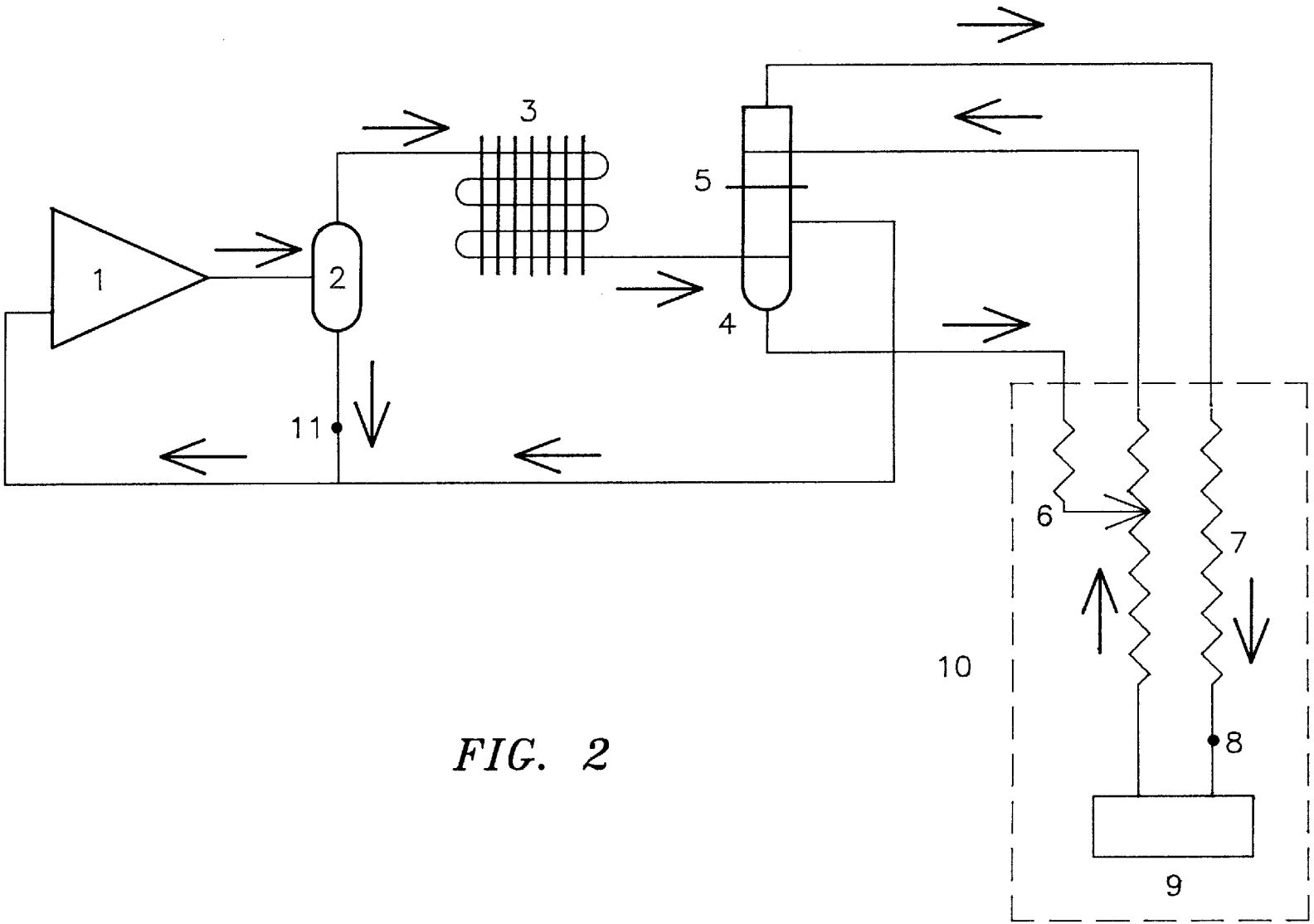
FIG. 2 is a simplified depiction of a typical Kleemenco type of cooler.

A simplified representation of such a cooler is depicted in FIG. 2 wherein, 1 is the compressor, 2 is the oil separator, 3 is the condenser, 4 is the vortex, 5 is the fractionating column, 6 is the capillary, 7 is the heat exchanger, 8 is the capillary, 9 is the evaporator and 10 is the cooling column.

In addition to the Kleemenco coolers just described, so-called thermoelectric coolers of the type manufactured by Marlow Indusrties, Inc., 10451 Vista Park Road, Dallas, Tex. 75238-1645 can be used as a backing pump as described herein. Although somewhat more costly than the Kleemenco coolers, such devices produce similar low temperatures, especially when used in tandem, and with similar advantages.

Peltier effect coolers can also be used as backing pump 28, however, they are yet more costly and the lower range of their temperature capabilities is just within the preferred range of the process of the instant invention.

Whatever of the previously described cryocooling systems is utilized in the pump system of the present invention, the interior or at least some significant portion thereof, and in the case of the Kleemenco cycle cooler, the cooling plates 30 are coated with palladium oxide that serves to convert any residual hydrogen to water at 150° K. The coating of palladium oxide may range from a few angstroms to several microns in thickness, so long as adequate palladium oxide is present to achieve the required conversion of hydrogen to water within the system.

In application, the vacuum system of the present invention is used to evacuate chamber 38 to UHV or XHV conditions by first opening valves 26 and 33 and permitting pressure reduction in chamber 38 and cryocooler 28 to a level of about $1\times10^{-3}$ to $1\times10^{-4}$ Torr after start-up of turbomolecular pump 34. Upon attainment of this pressure condition, valve 26 is closed, and cryocooler 28 is activated until a pressure of about $1.e^{-5}$ Torr and a temperature of about 150° K. are obtained in chamber 38 and cryocooler 28. Under this condition, hydrogen in chamber 38 and cryocooler 28 is converted through the presence of palladium oxide to water, as previously described, and evacuated from chamber 38 and cryocooler 28 as ice that is collected in the cryocooler. This permits attainment of UHV or XHV conditions within the various elements of the vacuum system. A further advantage of the use of a cryocooler in lieu of a mechanical backing pump in the pumping configuration described herein, is that, in the event of a power failure, vacuum is not lost in the turbopump or its associated vacuum chamber. Additionally, the cryocooler serves the same purpose as a mechanical backing pump in permitting the attainment of lower pressures (higher vacuums) than are attainable with the turbopump acting alone.

As the invention has been described, it will be apparent to those skilled in the art to which this invention applies that the same may be varied in many ways without departing from the spirit and scope of the invention. Any such modifications are intended to be included within the scope of the appended claims.

What is claimed is:

1. A method for obtaining a very low partial pressure of hydrogen in an ultra-high or extreme high vacuum condition in a vacuum system comprising:

A) a vacuum chamber connected to a vacuum pumping system comprising:

i) a turbomolecular pump connected to;

ii) a roughing pump connected to said turbomolecular pump via a first conduit that includes a first cut off valve; and iii) a cryopump connected to said turbomolecular pump via a second conduit that includes a second cut off valve and further including a coating of palladium oxide on at least a significant portion of the interior surface of said cryopump said method comprising:

a) cleaning said vacuum chamber and related components with ultra pure water;

b) baking out at a temperature above about 425° K.;

c) evacuating said cryopump and said vacuum chamber to a pressure below about $1.e^{-3}$ Torr with said roughing pump while said first cut off valve is open;

d) closing said first cut off valve;

e) opening said second cut off valve;

f) activating said cryopump to obtain a temperature below about 150° K. in said vacuum chamber and said cryopump; and g) completing evacuation of said vacuum chamber with said turbomolecular pump.

* * * * *